United States Patent [19]

Johnson et al.

[11] Patent Number: 4,810,938

[45] Date of Patent: Mar. 7, 1989

[54] HIGH EFFICACY ELECTRODELESS HIGH INTENSITY DISCHARGE LAMP

[75] Inventors: Peter D. Johnson; James T. Dakin, both of Schenectady; John M. Anderson, Scotia, all of N.Y.

[73] Assignee: General Electric Company, Schenectady, N.Y.

[21] Appl. No.: 103,248

[22] Filed: Oct. 1, 1987

[51] Int. Cl.[4] ..... H05B 41/16

[52] U.S. Cl. ..... 315/248; 315/344; 315/85; 313/492; 313/638

[58] Field of Search ..... 315/248, 344, 85, 236, 315/348, 267; 313/642, 639, 638, 492, 116, 493, 227, 224, 25

[56] References Cited

U.S. PATENT DOCUMENTS

| | | | |
|---|---|---|---|
| 3,860,854 | 1/1975 | Hollister | 313/607 |
| 4,017,764 | 4/1977 | Anderson | 315/248 |
| 4,180,763 | 12/1979 | Anderson | 315/248 |
| 4,422,011 | 12/1983 | Poesen et al. | 313/642 |
| 4,568,859 | 2/1986 | Houkes et al. | 313/492 |
| 4,591,759 | 5/1986 | Chalek et al. | 313/638 |
| 4,605,881 | 8/1986 | Dakin | 313/638 |

OTHER PUBLICATIONS

Dakin et al. application Serial No. 890,968, filed Jul. 29, 1986, (a continuation of abandoned application Serial No. 676,367 filed Nov. 29, 1984).

"An Ultra High Efficacy (UHE) HID Lamp", Zollweg et al., IES Journal, Jul. 1975, pp. 249–253.

"Electrodeless HID Lamp Study", Anderson et al., Lawrence Berkeley Laboratory, Final Report, Govt. Contract DE-AC03-765F00098, Jan. 1985 (Section 2).

"High Lumen Source (U)", Final Report, Govt. Contract DAAB07-71-C-0109, Jul. 1973, p. 37.

Johnson Application Serial No. 454,225, filed Dec. 29, 1982.

*Primary Examiner*—David K. Moore
*Assistant Examiner*—Michael Razavi
*Attorney, Agent, or Firm*—Marvin Snyder; James C. Davis, Jr.

[57] ABSTRACT

Improved efficacy and color rendition at white color temperatures is achieved in an electrodeless metal halide arc discharge lamp with a novel combination of arc tube fill materials, including sodium halide, cerium halide, and xenon. A preferred lamp structural configuration imparts further efficacy improvement at higher lamp operating temperatures and isothermal lamp operation.

18 Claims, 2 Drawing Sheets

HIGH EFFICACY ELECTRODELESS HIGH INTENSITY DISCHARGE LAMP

RELATED PATENT APPLICATIONS

In co-pending application Ser. No. 676,367, filed Nov. 29, 1984, and assigned to the assignee of the present invention, there is disclosed an electrode type lamp utilizing sodium iodided and xenon buffer gas as the arc tube fill materials. In the prior application it is recognized that xenon buffer gas exerts a favorable influence on the sodium D-line spectrum as well as prevents the tie-up of halide which occurs in prior art lamps when a mercury buffer gas is employed.

In another co-pending U.S. patent application Ser. No. 749,025, filed June 26, 1985, and also assigned to the present assignee, there is disclosed an electrodeless type sodium iodide arc lamp wherein the arc tube fill comprises sodium iodide, mercury iodide, and xenon in a sufficient quantity to limit chemical transport of energy from the plasma discharge to the walls of said arc tube. In the arc tube fill, the mercury iodide is present in a quantity less than the quantity of sodium iodide but sufficient to provide an amount of free iodine near the arc tube walls when the lamp is operating. The sodium iodide in the arc tube fill can also be present in sufficient quantity to provide a reservoir of condensate during lamp operation.

Since the present invention represents still further improvements made in the electrodeless form of the aforementioned high pressure discharge metal halide lamp and employs some of the same arc tube materials, both of the aforementioned co-pending patent applications are specifically incorporated herein by reference.

BACKGROUND OF THE INVENTION

This invention relates generally to high intensity discharge lamps wherein the arc discharge is generated by a solenoidal electric field and more particularly to use of a novel combination of fill materials in the arc tube component of such lamp to generate white color lamp emission at improved efficacy and color rendering indices.

The lamps described in the present invention are part of the class referred to as high intensity discharge lamps (HID) because in their basic operation a medium to high pressure gas is caused to emit visible wavelength radiation upon excitation typically caused by passage of current through an ionizable gas such as mercury or sodium vapor. The original class of such HID lamps was that in which the discharge current was caused to flow between a pair of electrodes. Since the electrode members in such electroded HID lamps were prone to vigorous attack by the arc tube fill materials, causing early lamp failure, the more recently developed solenoidal electric field lamps of this type have been proposed to broaden the choice of arc tube materials through elimination of the electrode component. Such more recently developed solenoidal electric field lamps are described in U.S. Pat. Nos. 4,017,764; 4,180,763; and 4,591,759, all assigned to the assignee of the present invention, and generate a plasma arc in the arc tube component during lamp operation, all in a previously known manner.

Such electrodeless HID lamps suffer from a number of problems, however, which primarily cause these lamps to operate less efficiently than other type lamp designs. Lamp efficiency or "efficacy", as used in the present application, means luminous efficacy as measured in conventional terms of lumens per watt. A different type problem experienced with electrodeless lamps is that they exhibit lower than acceptable color rendering capability in order to be employed for general purpose illumination. More particularly, general purpose illumination requires that objects illuminated by a particular light source display much the same color as when illuminated by natural sunlight. Such requirement is measured by known standards such as the C.I.E. color rendering index values (CRI), and CRI values of 50 or greater are deemed essential for commercial acceptability of lamps in most general lighting applications. A still further requirement for commercially acceptable general purpose illumination is the white color temperature provided with such lamp, which is fixed at about 3000° K. for the warm white lamp, about 3500° K. for the standard white lamp and about 4200° K. for the cool white lamp, as measured by the C.I.E. chromaticity x and y values. It is a further generally recognized principle that increasing efficacy for such type discharge lamps impairs the lamp color rendering capabilities. Thus, while the prior art electrodeless lamps partially meet the foregoing merit criteria as a result of utilizing some of the same arc tube fill materials that are employed in the present invention, it has not yet been recognized that a particular combination of all such arc tube materials is needed to achieve color improvement without adverse impact on efficacy in such lamps.

Accordingly, it is a principal object of the present invention to provide solenoidal electric field lamps demonstrating improvement in both efficacy and color rendition at white color temperatures.

Another object of the present invention is to provide a particular design for solenoidal electric field lamps which optimizes performance achieved with present arc tube fill materials.

Still another important object of the present invention is to operatively associate the arc tube fill materials for a solenoidal electric field lamp with the lamp structural configuration in a manner which optimizes the lamp performance.

The foregoing and other aspects of the present invention together with the features and advantages thereof, will become apparent from the following detailed description, when read in connection with the accompanying drawings.

SUMMARY OF THE INVENTION

In accordance with the invention, it has now been discovered that a particular combination of fill materials in the arc tube of an electrodeless metal halide arc lamp provides white color lamp emission at improved efficacy and color rendition. More particularly, this improved lamp construction features a light transmissive arc tube containing a fill which is mercury-free and comprises a combination of sodium halide and cerium halide along with xenon gas in the proper weight proportions to generate white color lamp emission at an efficacy of 200 lumens per watt (LPW) or greater and accompanied by color rendering indices (CRI) of at least 50. The white color temperature for the improved lamps extends from about 3000° K. up to about 5000° K. so that such lamps are suitable for general illumination purposes. Useful sodium and cerium halides in the present lamp fill can be selected from the group consisting of bromides, chlorides and iodides, including mixtures thereof such as sodium iodide (NaI) and cerium chloride ($CeCl_3$). The weight proportion of cerium halide is maintained no greater than the weight proportion of sodium halide in the present lamp fill in order to provide the aforementioned characteristics, with a reservoir of these fill materials in the arc tube being desirable to compensate for any loss of the individual constituents during lamp operation. With respect to the relative weight proportions of the aforementioned sodium and cerium halides, it has been found that too much sodium halide lowers CRI values whereas too much cerium halide lowers lamp efficacy. The composite white color lamp emission provided with the aforementioned fill materials consists mainly of otherwise conventional high pressure sodium discharge emission to which has been added visible radiation provided by cerium halide which extends in a continuous manner over the 400–700 nanometer visible wavelength region.

The present improvement is further attributable to maintaining controlled proportions of xenon gas in the lamp fill. Specifically, the replacement of mercury with xenon at high pressures to serve as a barrier or buffer against undesirable transport of thermal energy from the arc discharge to the arc tube walls further enhances efficacious radiation output in the present lamp. First of all, the use of high pressure mercury vapor assymetrically broadens the sodium D-line emission in the red spectral region, which is undesirable, while xenon broadens the sodium D-line emission more symmetrically to contribute greater desirable emission in the yellow and green spectral region. Secondly, the relatively high excitation energy of xenon as compared with mercury precludes xenon radiation in the present lamp as distinct from the energy loss experienced in undesirable spectral regions when a radiating mercury discharge is employed. Moreover, arc voltages are lower with xenon than mercury in the present lamps, thereby making the present lamps easier to start and operate. A still further performance advantage experienced in the present lamps by replacing mercury with xenon in the arc tube fill is attributable to the relatively lower thermal conductivity of xenon. Such lower thermal conductivity more effectively avoids undesirable dissocation of the halide materials in the arc discharge with subsequent recombination of the halide materials at or near the arc tube walls. A higher observed efficacy in electrodeless metal halide lamps having the above described sodium and cerium halide arc tube fills when xenon replaces the conventional mercury is also presumed attributable to avoiding a tie-up of said halides by the mercury constituent.

The amount of xenon employed in the present arc tube fill to achieve the above noted lamp performance gains is a sufficient quantity, dependent upon the arc tube internal volume, to limit the transport of thermal energy by conduction from the arc discharge to the walls of the arc tube. As above noted, the xenon buffer gas participates actively in achieving the performance gains primarily due to eliminating drawbacks which the conventional use of high pressure mercury buffering gas has now been found to cause in these lamps. Specifically, xenon may be present in a sufficient quantity, providing a partial pressure in the range of about 60 Torr and higher at room temperature or about 600 Torr and higher at the operating temperature of the lamp of the present invention in order to produce these performance gains. Increasing the xenon partial pressure to 500 Torr at room temperature can further improve the lamp performance. For example, one tested lamp having a structural configuration of the "pillbox" type, hereinafter further described, wherein the arc tube measured 20 millimeters outside diameter, or O.D., ×17 millimeters in height, and was filled with 5 milligrams NAI and 2.3 milligrams $CeCl_3$ along with xenon at 500 Torr partial pressure at room temperature, achieved 203 LPW efficacy and a 54 CRI value at a color temperature of 3699° K. Similarly, a large size arc tube having the same structural configuration and filled with 101 milligrams NaI, 9.8 milligrams $CeCl_3$, 5 milligrams TlI, and xenon at a partial pressure of 200 Torr at room temperature, exhibited 193 LPW and 50.1 CRI at a color temperature of 3610° K.

As above indicated, the present arc tube fill may include additional vaporizable metal atoms other than mercury to furnish still other radiating species in the arc discharge. The color of lamp emission can be altered, without adversely affecting performance, by employing minor amounts of indium halide and lithium halide to impart monochromatic blue and red emission, respectively, as well as by employing a thallium halide addition to provide more green color emission to the lamp discharge. Other supplemental lamp color temperature modifying atoms can be employed in the arc discharge, including other alkali metals such as cesium, as well as alkaline earth metals, such as barium, and still further including other rare earth metals, to provide continuous radiation across the visible spectral region. To further illustrate a useful source in the lamp fill for the latter category of lamp color temperature modifying atoms, halides of dysprosium, holmium, ytterbium and thulium are contemplated as being chemically compatible in the present type lamp design. Accordingly, it follows that color temperature in the present lamps can be desirably modified, without deleterious effect upon either efficacy or color rendition, when the arc tube fill includes metal ions providing supplemental monochromatic radiation or continuous radiation in the visible spectral region, and further including both types of supplemental radiative species. Since all radiating species in the present arc tube fill limit radiation output primarily to the visible spectral region, it can also be appreciated that energy losses in such lamps which decrease lamp efficacy, such as infrared losses, are thereby minimal.

A preferred lamp structural configuration utilizing the above disclosed arc tube materials of the present invention to optimize lamp performance features a cylindrically-shaped arc tube of a height less than its outside diameter, a light transmissive outer envelope disposed around the arc tube and defining a space therebetween, and excitation means for coupling radio-frequency energy to the arc tube fill. As such, these improved lamps can be operated as relatively isothermal devices not experiencing various thermal losses found in electroded lamps, particularly at the walls and ends, as well as found in prior art electrodeless lamps of the type having a relatively long and narrow arc tube. Since efficacy of high intensity discharge lamps is limited by such thermal losses, it becomes desirable to avoid such impairment to a greater extent than heretofore found possible in prior art high intensity discharge lamps which generally are operated at cold spot wall temperatures of below 750° C. By combining the above preferred lamp design configuration with the present arc tube materials it is now possible to achieve more nearly isothermal lamp operation, with cold spots around 900° C., for an efficacy gain attributable to increased vapor pressure of the lamp fill. In the preferred lamp design configuration, the arc tube can be formed of a high temperature glass, such as fused quartz, or an optically transparent ceramic, such as polycrystalline alumina. The filled arc tube generates a plasma arc during lamp operation by excitation from a solenoidal electric field employed in the lamp, all in known manner. The excitation is created by a magnetic field, changing with time, to establish within the tube an electric field which closes completely upon itself, resulting in the light-producing high intensity discharge. The excitation source in the preferred lamp design comprises an excitation coil disposed outside the outer lamp envelope and connected to a power supply through an impedance matching network. The spacing between the arc tube and outer envelope members in the preferred lamp device can be occupied by thermal energy barrier means, such as metal baffles or quartz wool, or even a vacuum. Such thermal barrier means desirably reduces heat loss from the lamp, which would otherwise be considerable due to the more elevated lamp operating temperatures and isothermal manner of lamp operation now being achieved.

DETAILED DESCRIPTION OF THE PREFERRED EMBODIMENT

Figure 1:
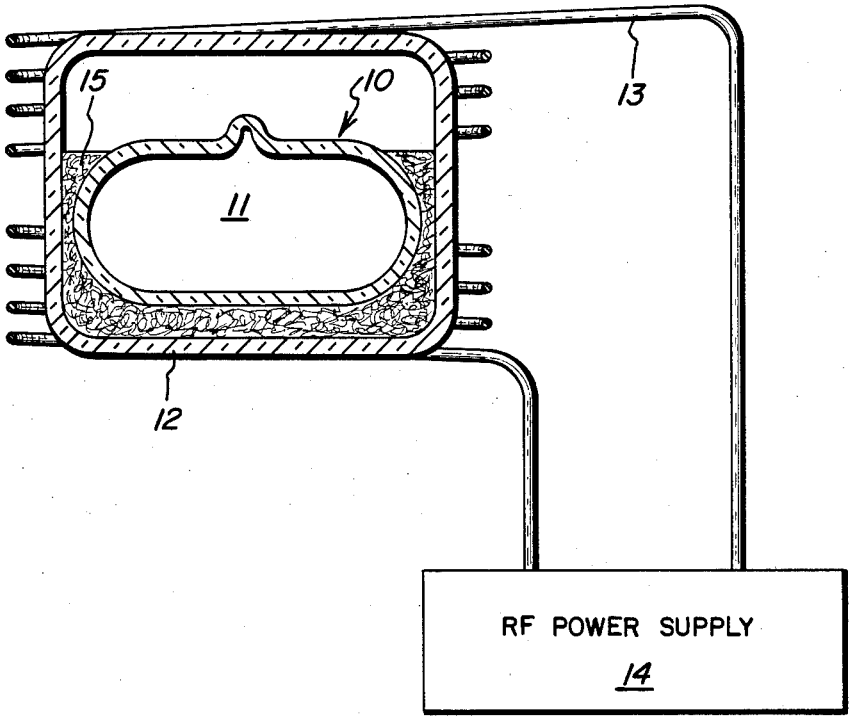
FIG. 1 is a cross-sectional side view depicting one electrodeless lamp configuration of the present invention employing the present arc tube material composition.

FIG. 1 depicts an electrodeless arc discharge lamp which includes an arc tube 10 for containing a fill 11. Arc tube 10 comprises a light-transmissive material, such as fused quartz or a refractory ceramic material such as sintered polycrystalline alumina. An optimum shape for arc tube 10, as depicted, is a flattened spherical shape or a short cylindrical (e.g. hockey puck or pillbox) shape with rounded edges. The major diameter of arc tube 10 is also shown to be greater than its height dimension. An outer envelope 12 is disposed around arc tube 10. Outer envelope 12 is light-transmissive and may also be comprised of quartz or a refractory ceramic. Convective cooling of arc tube 10 is limited by outer envelope 12. A blanket of quartz wool 15 may also be provided between arc tube 10 and outer envelope 12 to further limit cooling. A primary coil 13 and a radio-frequency (RF) power supply 14 are employed to excite a plasma arc discharge in fill 11. As previously indicated, this configuration including primary 13 and RF power supply 14 is commonly referred to as a high intensity discharge solenoidal electric field (HID-SEF) lamp. The SEF configuration is essentially a transformer which couples radio-frequency energy to a plasma, the plasma acting as a single-turn secondary for the transformer. An alternating magnetic field which results from the RF current in primary coil 13 creates an electric field in arc tube 10 which closes upon itself completely. Current flows as a result of the electric field and an arc discharge results in arc tube 10. Since a more detailed description for such HID-SEF lamp structures is found in previously cited U.S. Pat. Nos. 4,017,764 and 4,180,763, the disclosures of both are hereby specifically incorporated by reference into the present application.

An exemplary frequency of operation for RF power supply 14 is 13.56 megahertz. Typical power input to the lamp can be in the range of 100–2000 watts.

Figure 2:
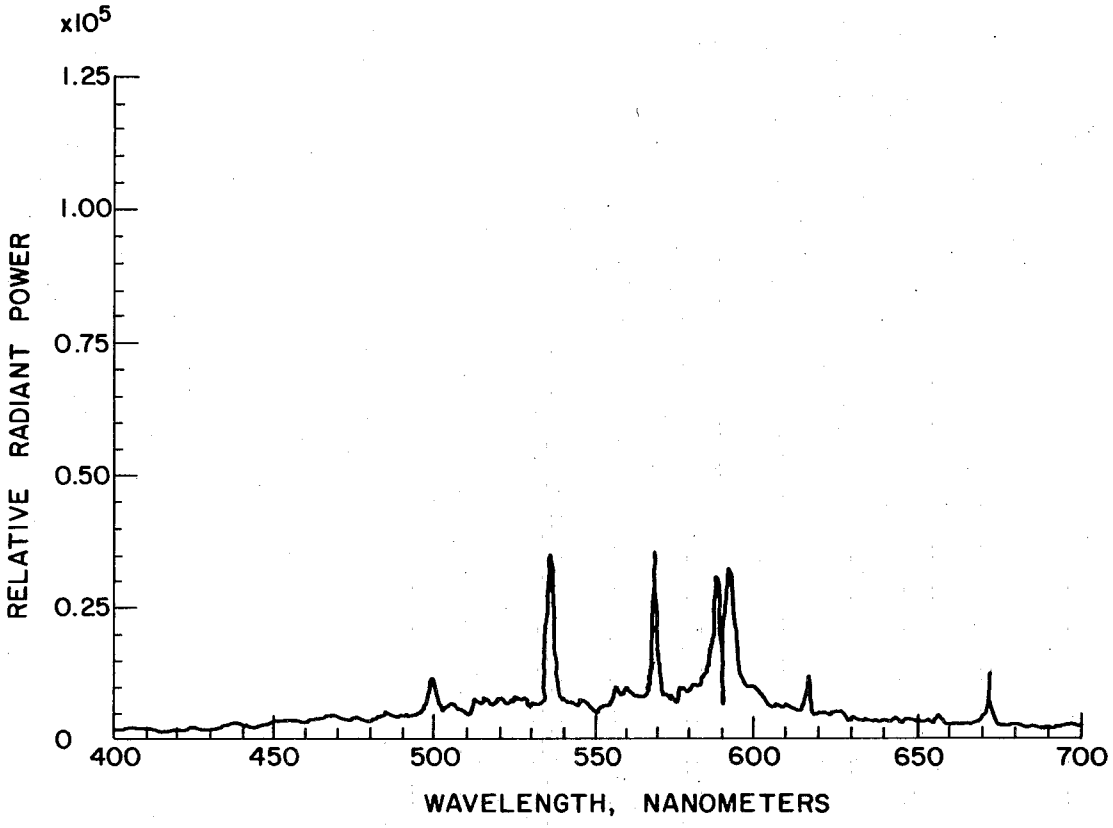
FIG. 2 is a spectral emission diagram for a typical lamp construction utilizing the arc tube fill material composition of the present invention.

Lamps having the above described structural configuration were built and found to exhibit the spectral emission curve depicted in FIG. 2. More particularly, the depicted emission curve represents such HID-SEF lamp emission, with the lamp further exhibiting a color temperature of around 3985° K., a 182 LPW efficacy, and a 54.8 CRI value. The depicted emission is provided in composite fashion formed by the line spectrum from a high pressure sodium discharge which further includes the visible spectral continuum, with cerium emission also being present in the lamp discharge. The arc tube fill in this particular lamp consisted of approximately 100 milligrams NaI, approximately 5.1 milligrams TlI, approximately 19.8 milligrams $CeCl_3$ and xenon gas at a partial pressure of approximately 200 Torr at room temperature. The following examples are provided to demonstrate still other successfully tested arc tube fills for the present metal halide arc lamp construction.

EXAMPLE I

An arc tube having 20 millimeter O.D.×17 millimeter height dimensions was filled with approximately 6 milligrams NaI, 2.3 milligrams $CeCl_3$, and approximately 500 Torr partial pressure of xenon gas at room temperature. The lamp operated at approximately 265 watts input power to produce 203 LPW and 54 CRI values at a color temperature of approximately 3699° K. which approaches the cool white oval.

EXAMPLE II

The same size arc tube as in Example I above was filled with approximately 6.1 milligrams NaI, 3 milligrams $CeI_3$, and 500 Torr xenon partial pressure buffering gas at room temperature. The subsequent operation of the lamp at approximately 206 watts input power provided 195 LPW efficacy, 49 CRI, and a lamp color temperature of approximately 3290° K. which approaches the warm white color oval.

EXAMPLE III

In this example, an arc tube having dimensions of 15 millimeters O.D.×13 millimeters in height was employed. The arc tube fill consisted of approximately 1 milligram NaI and 1 milligram $CeCl_3$ along with xenon gas at a partial pressure of approximately 500 Torr at room temperature. When supplied with 202 watts input power, the lamp exhibited 185 LPW and 57 CRI at a color temperature of approximately 4856° K. which approaches other recognized white color ovals.

EXAMPLE IV

An arc tube having the same physical dimensions as in Example I above was filled with 6.1 milligrams NaI, 1.4 milligrams $CeCl_3$, 0.5 milligrams TlI, and 500 Torr partial pressure of xenon at room temperature. At 204 watts input power the lamp yielded 204 LPW and 49 CRI at a color temperature of 3381° K. which approaches the standard white color oval.

EXAMPLE V

An arc tube with an O.D. of 54 millimeters and 25 millimeters in height was filled with approximately 100 milligrams NaI, 5.1 milligrams TlI, 19.8 grams $CeCl_3$, and 200 Torr partial pressure of xenon at room temperature. When operated at 1087 watts input power the lamp demonstrated 182 LpW, 54.8 CRI and a color temperature of 3985° K. which again approaches the cool white oval.

The above lamp embodiments exhibit optimum performance for a HID-SEF type lamp containing the present combination of arc tube fill materials including sodium halide, cerium halide and xenon gas. As has been shown, efficacy of over 200 LPW is gained, accompanied by CRI values of 50 or greater, and lamp color temperatures in the white color spectral region are varied by addition of still other vaporizable metal atoms which radiate in the lamp discharge. As evident in the above examples, such supplemental radiating species are incorporated in the arc tube fill as halide compounds so as to be vaporizible at the lamp operating temperatures without requiring intermediate conversion.

The foregoing describes a broadly useful, improved HID electrodeless lamp exhibiting superior performance. It will be apparent from the foregoing description, however, that various modifications in the specific embodiments above described can be made without departing from the spirit and scope of the present invention. For example, color correcting radiators other than those specifically illustrated can be included in the present lamp fill in minor amounts to meet specific lamp requirements, so long as these radiators are compatible during lamp operation. Additionally, physical configurations for the lamp other than those above disclosed are possible to make still better use of the lamp fill medium. It is intended to limit the present invention, therefore, only by the scope of the following claims.

What we claim is:

1. A mercury-free electrodeless metal halide arc lamp comprising:

(a) a light transmissive arc tube for containing an arc discharge;

(b) a fill disposed in said arc tube to generate said arc discharge, said fill including sodium halide and cerium halide, said halides selected from the group consisting of bromides, chlorides, and iodides, including mixtures thereof, said sodium halide and cerium halide being combined in weight proportions to generate white color lamp emission at improved efficacy and color rendition; and to provide a partial pressure in the range of about 60 Torr or higher at room temperature;

(c) said fill further including xenon in a sufficient quantity to limit the transport of thermal energy from said arc discharge to the walls of said arc tube; and (d) excitation means for coupling radio-frequency energy to said fill.

2. The lamp of claim 1 wherein the weight proportion of cerium halide is no greater than the weight proportion of sodium halide.

3. The lamp of claim 1 wherein an amount of sodium halide is selected so that a reservoir of sodium halide condensate is present during lamp operation.

4. The lamp of claim 1 wherein an amount of cerium halide is selected so that a reservoir of cerium halide condensate is present during lamp operation.

5. The lamp of claim 1 wherein the selected amounts of both sodium halide and cerium halide provide a reservoir of mixed condensates during lamp operation.

6. The lamp of claim 1 wherein the quantity of xenon is sufficient to provide a partial pressure in the range of about 600 Torr and higher at the operating temperature of the lamp.

7. The lamp of claim 1 wherein the selected sodium halide is sodium iodide.

8. The lamp of claim 1 wherein the selected cerium halide is cerium chloride.

9. The lamp of claim 1 wherein the selected sodium halide is sodium iodide and the selected cerium halide is cerium chloride.

10. The lamp of claim 1 wherein the fill further includes metal lamp color temperature modifying atoms.

11. The lamp of claim 10 wherein a combination of said metal atoms imparts blue, green and red emission to the lamp emission spectrum.

12. The lamp of claim 10 wherein the selected metal atoms are thallium.

13. The lamp of claim 10 wherein the metal atoms are present in the fill as metal halide compounds.

14. The lamp of claim 11 wherein the fill includes rare earth halides, the rare earths being selected from the group consisting of dysprosium, holmium, ytterbium, and thulium to provide supplemental continuous radiation in the visible spectrum.

15. The lamp of claim 10 wherein the fill includes metal atoms providing supplemental monochromatic radiation in the visible spectrum.

16. A mercury-free electrodeless metal halide arc lamp comprising:

(a) a light transmissive arc tube for containing an arc discharge, said arc tube being cylindrically shaped with the height of said arc tube being less than its outside diameter;

(b) a light transmissive outer envelope disposed around said arc tube and defining a space therebetween;

(c) a fill disposed in said arc tube to generate said arc discharge, said fill including sodium halide and cerium halide, said halides selected from the group consisting of bromides, chlorides and iodides, including mixtures thereof, said sodium halide and cerium halide being combined in weight proportions to generate white color lamp emission at improved efficacy and color renditions;

(d) said fill further including xenon in a sufficient quantity to limit the transport of thermal energy from said arc discharge to the walls of said arc tube as well as to increase lamp efficacy; to provide a partial pressure in the range of about 60 Torr or higher at room temperature and (e) excitation means for coupling radio-frequency energy to said fill.

17. The lamp of claim 16 wherein the space between the light transmissive outer envelope and said arc tube is evacuated.

18. The lamp of claim 16 wherein the space between the light transmissive outer envelope and said arc tube is occupied with thermal energy barrier means.

* * * * *